US007854471B2

(12) United States Patent
Fujii et al.

(10) Patent No.: US 7,854,471 B2
(45) Date of Patent: Dec. 21, 2010

(54) CONSTRUCTION MACHINE

(75) Inventors: Tokuo Fujii, Hiroshima (JP); Isao Miyachi, Hiroshima (JP); Kazuaki Kobayashi, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 0 days.

(21) Appl. No.: 12/472,891

(22) Filed: May 27, 2009

(65) Prior Publication Data

US 2009/0309343 A1 Dec. 17, 2009

(30) Foreign Application Priority Data

Jun. 16, 2008 (JP) ..... 2008-157010

(51) Int. Cl.
*B60J 7/00* (2006.01)

(52) U.S. Cl. ..... 296/190.03; 180/327; 37/379

(58) Field of Classification Search ..... 296/1.02, 296/190.03, 190.01, 190.04, 190.05, 190.08; 37/379; 180/89.12, 89.13, 89.16, 327
See application file for complete search history.

(56) References Cited

U.S. PATENT DOCUMENTS 7,001,135 B2 * 2/2006 Shimokakiuchi et al. .... 414/687
7,320,380 B2 * 1/2008 Ueda et al. ..... 180/327
7,338,113 B2 * 3/2008 Hiraoka ..... 296/190.03
2006/0000123 A1 * 1/2006 Chikaishi et al. ..... 37/379

FOREIGN PATENT DOCUMENTS

| | | |
|---|---|---|
| JP | 5-125743 | 5/1993 |
| JP | 7-268906 | 10/1995 |
| JP | 8-134956 | 5/1996 |
| JP | 2001-107388 | 4/2001 |
| JP | 2001-107396 | 4/2001 |
| JP | 2003-20682 | 1/2003 |
| JP | 2003-20683 | 1/2003 |
| JP | 2007-169917 | 7/2007 |

* cited by examiner

*Primary Examiner*—Joseph D Pape
(74) *Attorney, Agent, or Firm*—Oblon, Spivak, McClelland, Maier & Neustadt, L.L.P.

(57) ABSTRACT

Handrail mounts are provided in a bottom portion of a cast upper frame, and lower ends of side supports of a handrail are attached to the above handrail mounts. A base plate for attaching a floor plate is hanged and fixed between the side supports at a higher position than the attachment position, and a front end part of the floor plate is attached to the above base plate.

4 Claims, 5 Drawing Sheets

CONSTRUCTION MACHINE

BACKGROUND OF THE INVENTION

1. Field of the Invention

The present invention relates to a construction machine in which a handrail is attached to an upper rotating body such as a small-sized hydraulic excavator.

2. Description of the Related Art

A description will be given to the related art taking a small-sized hydraulic excavator (referred to as a mini excavator) serving as a preferred example of the present invention as an example.

The above excavator is provided with an upper rotating body 2 disposed on a crawler type lower traveling body 1 rotatably around a vertical axis, and a working attachment 3 installed in a front end part of the above upper rotating body 2 as shown in FIG. 7.

The working attachment 3 is provided with a raising and lowering boom 4. An arm 5 is attached to a front end of the above boom 4, and a bucket 6 is attached to a front end of the above arm 5. The reference numeral 7 denotes a boom raising and lowering cylinder for raising and lowering the boom 4, the reference numeral 8 denotes an arm cylinder for actuating the arm 5, and the reference numeral 9 denotes a bucket cylinder for actuating the bucket 6.

An operator's seat 11, an engine and other devices (not shown) and an operation device (two kinds of operation levers 12 and 13 are shown as an example) are provided taking an upper frame 10 of the upper rotating body 2 as a base.

A handrail 14 is attached over the substantially entire width before the operator's seat 11 in the upper rotating body 2. The working attachment 3 is installed immediately before the above handrail 14.

As shown in FIG. 8, the handrail 14 is formed by left and right side supports 15, 15 and a lateral railing 16 for supporting a body of an operator when the operator leans forward so as to confirm an excavating part or gets on or off the machine.

FIG. 8 shows a case where the handrail 14 is attached to a metal-sheet frame, that is an upper frame 10A formed by welding and connecting a plurality of metal plate materials.

In the case of the metal-sheet upper frame 10A, a floor plate 18 is attached astride side decks 17, 17 attached on the left and right sides. Further, lower end parts of the side supports 15, 15 of the handrail 14 are fixed to an upper surface of the above floor plate 18 with bolts.

A configuration of the metal-sheet upper frame is shown in Japanese Patent Laid-Open No. 2001-107388, and a structure for attaching the handrail to the upper frame is shown in Japanese Patent Laid-Open No. 2001-107396.

Meanwhile, in the case of a cast frame, that is an upper frame entirely cast as an integrated body, high columnar bosses 19 are conventionally provided on the left and right sides (one side is shown in the figure) of a bottom portion of an upper frame 10B as shown in FIG. 9. The floor plate 18 is attached to upper ends of the above bosses 19, and the supports 15 of the handrail are fixed to the above floor plate 18 with bolts. The reference numeral 20 denotes a bolt for attaching the floor plate 18 to the boss 19, the reference numeral 21 denotes a bolt for attaching the support 15 of the handrail to the floor plate 18, and the reference numeral 22 denotes a nut for attaching the support 15 of the handrail to the floor plate 18.

It should be noted that in the above case, the side decks 17 do not function as a member for attaching the floor plate 18.

Such a configuration of the cast upper frame is shown in Japanese Patent Laid-Open No. 2003-20683.

However, conventionally, in any case of the metal-sheet and cast upper frames 10A and 10B, only the lower ends of the side supports 15, 15 of the handrail 14 are attached to and supported by the floor plate 18. Therefore, there is a limitation on improvement in attachment strength of the handrail 14.

In the case of the cast upper frame 10B shown in FIG. 9, the high bosses 19 have to be provided in a bottom surface of the frame. Therefore, there is a problem that casting cost is increased.

SUMMARY OF THE INVENTION

It is an object of the present invention to provide a construction machine capable of enhancing attachment strength of a handrail and strength of the handrail itself and also reducing casting cost in the case of a cast upper frame.

The present invention is a construction machine, comprising a lower traveling body, an upper rotating body disposed on the lower traveling body, and a handrail formed by left and right side supports and a lateral railing both attached to a front part of an upper frame forming the upper rotating body. Further, lower ends of the side supports of the handrail are attached to an upper surface of a bottom portion of the upper frame, and a front end part of a floor plate forming a floor surface is attached astride the side supports at a higher position than a position where the side supports are attached to the upper frame.

According to the present invention, the lower ends of the side supports of the handrail are attached to the upper surface of the bottom portion of the upper frame, and the front end part of the floor plate is attached to the side supports at the higher position than the above attachment position. Therefore, the side supports can be fixed at two positions of the lower ends and intermediate points and a load can be divided. Thereby, it is possible to enhance the attachment strength of the handrail and the strength of the handrail itself.

In the case of the cast upper frame, there is no need for providing high attachment bosses for attaching the floor plate in a bottom surface of the upper frame unlike a conventional example. Therefore, it is possible to reduce the casting cost of the upper frame.

The above construction machine may further comprise handrail mounts provided in the bottom portion of the cast upper frame. Preferably, attachment holes passing through in the up and down direction may be provided in the handrail mounts, attachment plates provided with screw holes may be fixed to the lower ends of the side supports of the handrail, and attachment screws may be screwed into the screw holes of the attachment plates in a state of passing through the attachment holes from below so that the side supports of the handrail are attached to the bottom portion of the upper frame.

In the above case, there is no need for providing a screw hole whose processing is very troublesome for the cast upper frame. Therefore, the upper frame is easily processed and processing cost is reduced.

Since the supports are screwed from the back side of the upper frame, work space is wider than the case of screwing from the front side and there is no obstacle. Therefore, an attachment work of the lower ends of the supports to the upper frame is easily performed.

The construction machine may further comprise a base plate for attaching the floor plate, the base plate being hanged and fixed between the side supports of the handrail, and preferably the front end part of the floor plate may be attached to the base plate. Alternatively preferably, notches may be provided at corresponding positions of the base plate and the front end part of the floor plate so as to face each other, a lever through hole may be formed by the notches, and a lower end part of a boot for covering an extra clearance in a state that an operation lever passes through the lever through hole, may be engaged with and fixed to a peripheral part of the lever through hole.

In the above case, the entire front end part of the floor plate can be supported by the base plate. Therefore, it is possible to enhance the attachment strength of the floor plate in comparison to the case of attaching only two points on the left and right sides of the front end part to the bosses.

After attaching the small and light base plate to the side supports, the front end part of the large and heavy floor plate can be disposed on and attached to the above base plate. Therefore, an assembling property is improved and the machine is easily assembled.

Further, it is possible to assemble floor assembling members which are conventionally assembled to the floor plate such as a front cover, a pedal and an operation lever to the above base plate. Therefore, the number of the parts is decreased so as to reduce the cost, and the machine is more easily assembled.

Here, the notches are provided in the base plate and the floor plate, the lever through hole is formed by the above notches, and the lower end part of the boot for covering the extra clearance of the lever through hole in a state that the operation lever passes through the lever through hole, is engaged with and fixed to the peripheral part of the lever through hole. Therefore, there is no need for a member exclusively used for attaching the boot, and hence it is possible to decrease the number of the parts and the man-hour for assembling, and reduce the cost and improve the assembling property.

Space under the floor can be largely opened by the notches of the base plate in a state that the floor plate and the boot are removed. Therefore, it is advantageous in terms of maintenance around a link of the operation lever or the like.

DESCRIPTION OF THE PREFERRED EMBODIMENTS

A description will be given to embodiments of the present invention with FIGS. 1 to 6.

The following embodiments show a case where a cast upper frame 30 is used, as an example.

First Embodiment

Figure 1:
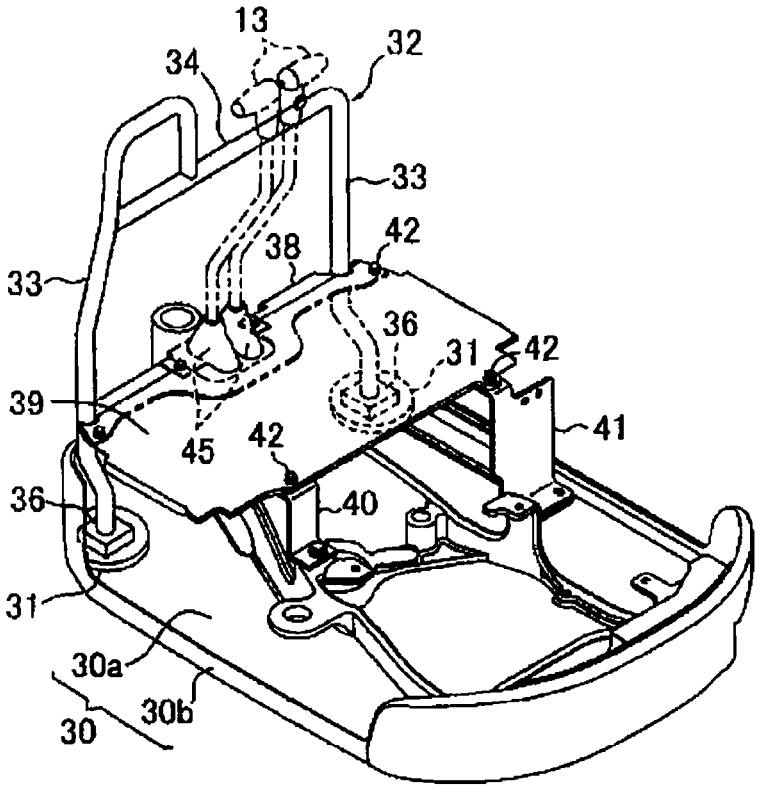
FIG. 1 is a perspective view of a state that a handrail and a floor plate are attached to an upper frame in a first embodiment of the present invention.
Figure 2:
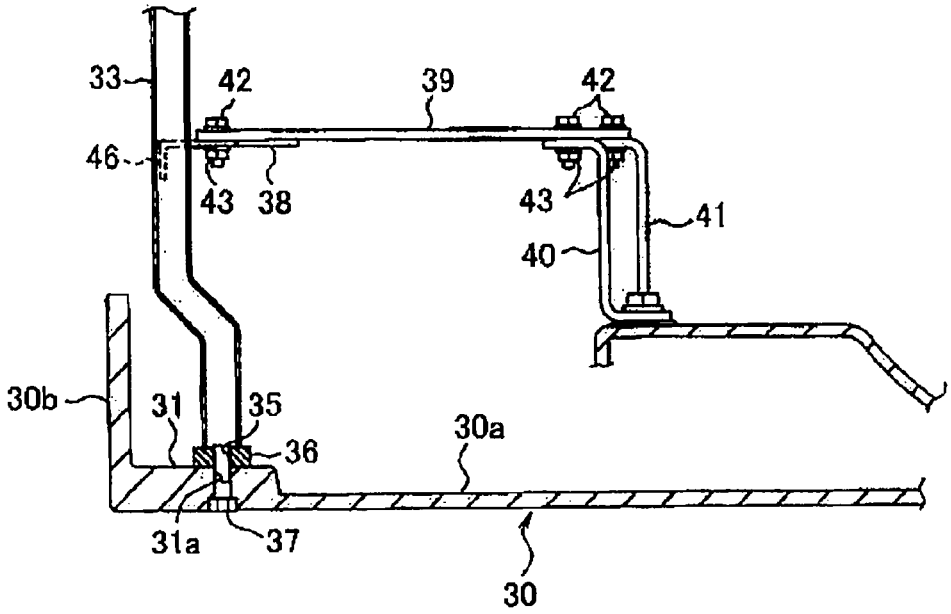
FIG. 2 is a partially enlarged sectional view of FIG. 1.
Figure 3:
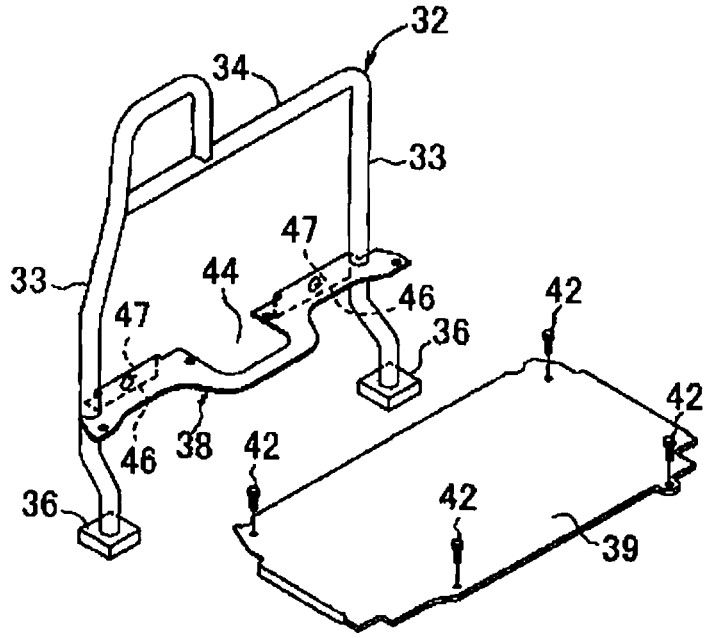
FIG. 3 is a perspective view of the handrail and the floor plate.

Refer to FIGS. 1 to 3

As shown in FIGS. 1 and 2, the upper frame 30 is formed into a shallow container provided with a standing edge portion 30*b* in a periphery thereof. Handrail mounts 31, 31 are provided on the left and right sides of a front end part of a bottom portion 30*a*.

The handrail mounts 31, 31 are only required to be slightly and partially bulged upward as a thick part. However, there is no need for protruding long in a columnar shape unlike a boss 19 in FIG. 9.

An attachment hole (not a screw hole but a simple through hole) 31*a* passing through in the up and down direction is provided in each of the handrail mounts 31, 31.

Meanwhile, a handrail 32 is formed by side supports 33, 33 and a lateral railing 34. Attachment plates 36, 36 are attached to lower ends of the side supports 33, 33.

A screw hole 35 (refer to FIG. 2) is provided in each of the attachment plates 36, 36. An attachment screw (bolt) 37 is screwed into the screw hole 35 in a state of passing through the attachment hole 31*a* of each of the handrail mounts 31, 31 from below. Thereby, the lower ends of the side supports 33, 33 are attached to the bottom portion 30*a* of the upper frame.

A base plate 38 for attaching a floor plate, is horizontally attached at a higher position in lower parts of the side supports 33, 33 than a position where the lower ends of the side supports 33, 33 of the handrail are attached to the bottom portion 30*a* of the upper frame.

The above base plate 38 is hanged and fixed between the side supports 33, 33 by welding left and right end parts thereof to outer peripheral surfaces of the side supports 33, 33. The left and right sides of a front end part of a floor plate 39 forming a floor surface, are attached to an upper surface of the above base plate 38 by bolts 42 and nuts 43. The left and right sides of a back end part of the floor plate 39 are attached to left and right brackets 40 and 41 separately attached on the upper frame 30 by the bolts 42 and the nuts 43.

It should be noted that a lever through hole 44 is formed in the base plate 38 by curving a central part of the base plate 38 in the left and right direction into a backward U shape in a plane view as shown in FIG. 1. Lower parts of traveling operation levers 13, 13 pass through the above lever through hole 44 and are introduced to under the floor. In FIG. 1, the reference numerals 45, 45 denote pleated shape boots for covering an extra clearance of the lever through hole 44 in a state that the operation levers 13, 13 pass through the lever through hole 44.

As shown in FIGS. 1 to 3, front cover attachment portions 46, 46 suspended downward are provided on the left and right sides of the base plate 38. A front cover (not shown) for covering a front surface of the upper frame is attached to the above front cover attachment portions 46, 46.

Further, pedal attachment holes 47, 47 are provided in the front cover attachment portions 46, 46. Operation pedals (now shown) are attached with using the above pedal attachment holes 47, 47.

As mentioned above, the lower ends of the side supports 33, 33 of the handrail 32 are attached to an upper surface of the bottom portion 30*a* of the upper frame. The base plate 38 for attaching the floor plate is hanged and fixed between the side supports 33, 33 at the higher position than the above attachment position, and the front end part of the floor plate 39 is attached to the above base plate 38. Therefore, the side supports 33, 33 can be fixed at two positions of the lower ends and intermediate points respectively, and a load can be divided into the two positions. Thereby, it is possible to enhance attachment strength of the handrail 32 and strength of the handrail itself.

Figure 9:
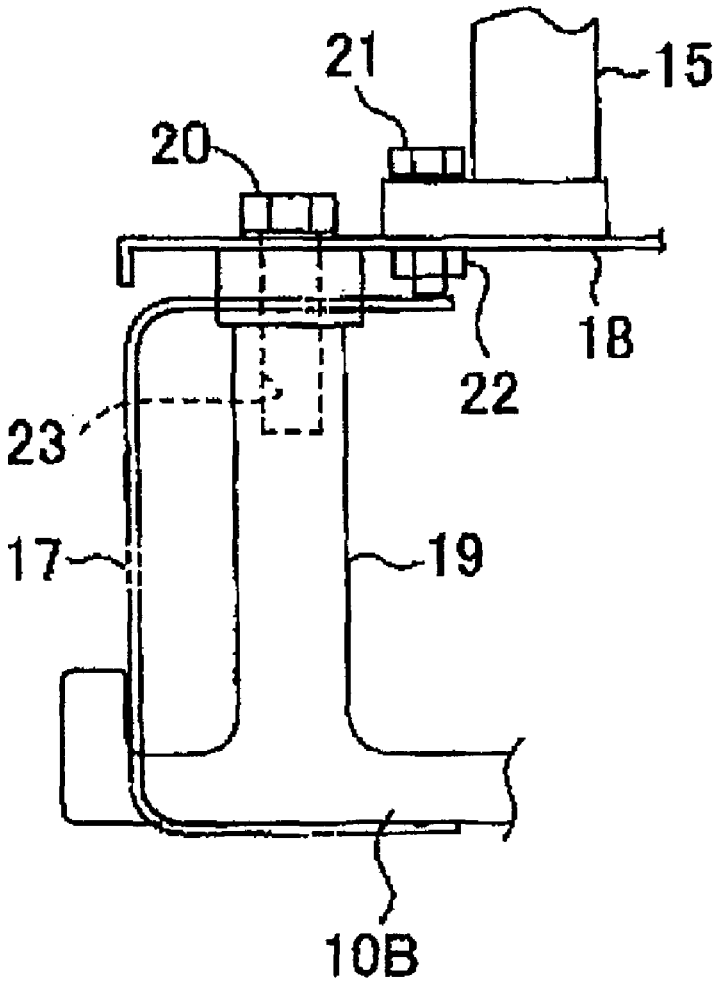
FIG. 9 PRIOR ART
FIG. 9 is a partially front view showing the handrail attachment structure of the small excavator with using a conventional cast upper frame.

In the case of the cast upper frame 30 shown in the present embodiment, there is no need for protrudingly providing the high attachment bosses 19 for attaching the floor plate in a bottom surface of the upper frame unlike a conventional structure shown in FIG. 9. Therefore, casting of the upper frame 30 is easily performed and casting cost is reduced.

Further, the entire front end part of the floor plate 39 can be supported by the base plate 38. Therefore, it is possible to enhance attachment strength of the floor plate 39 in comparison to the case of attaching only two points on the left and right sides of the front end part of the floor plate 39 to the bosses.

After attaching the small and light base plate 38 to the side supports 33, 33, the front end part of the large and heavy floor plate 39 can be disposed on and attached to the above base plate 38. Therefore, an assembling property is improved and the machine is easily assembled.

Further, the attachment plate 36 with the screw hole 35 is provided in the lower end of the support, while the attachment hole (through hole) 31*a* is provided in the handrail mount 31 of the upper frame 30. And the attachment screw 37 is screwed into the screw hole 35 in a state of passing through the attachment hole 31 so as to attach the lower end of the support to the upper frame 30. Therefore, there is no need for performing troublesome screw hole processing to the upper frame 30. Thus, it is possible to reduce processing cost of the upper frame 30.

In the above case, since the lower ends of the supports (the attachment plates 36, 36) are screwed to the upper frame 30 from the back side, work space is wider than the case of screwing from the front side, and there is no obstacle. Therefore, an attachment work of the lower ends of the supports to the upper frame 30 is easily performed.

In addition, it is possible to assemble floor assembling members which are conventionally assembled to the floor plate such as a front cover, a pedal and an operation lever to the base plate 38, as mentioned above. Therefore, the number of the parts is decreased so as to reduce the cost, and the machine is more easily assembled.

Second Embodiment

Figure 4:
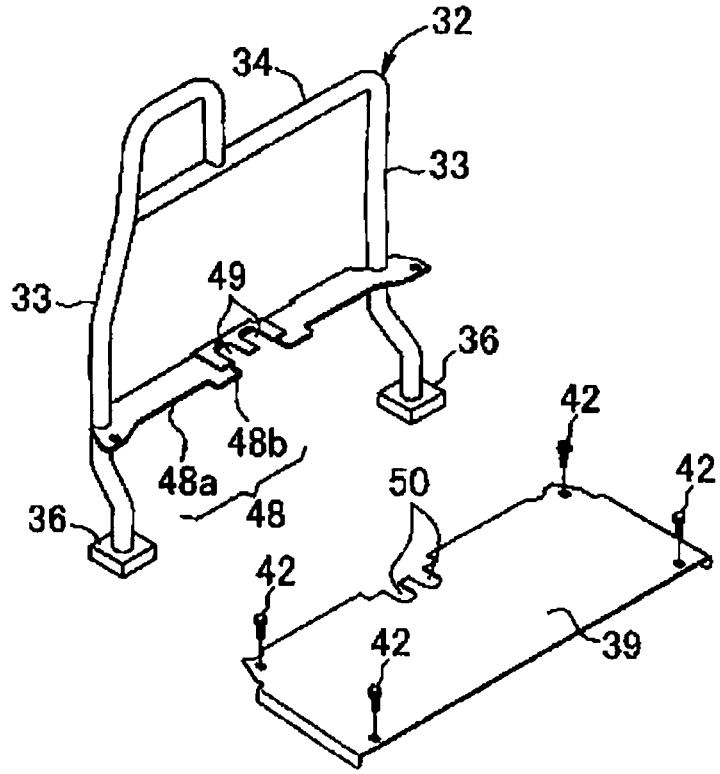
FIG. 4 is a perspective view of a handrail and a floor plate in a second embodiment of the present invention.
Figure 5:
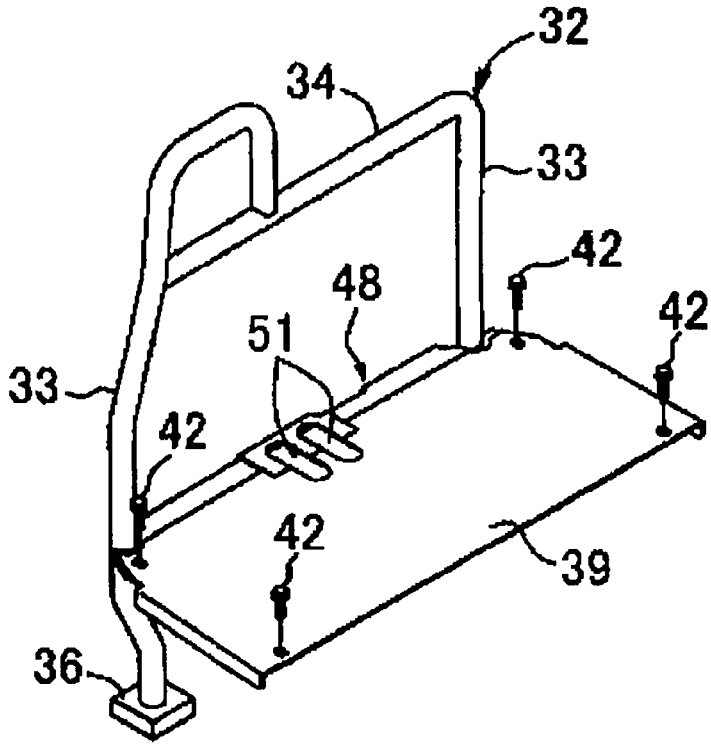
FIG. 5 is a perspective assembly view of the handrail and the floor plate of FIG. 4.
Figure 6:
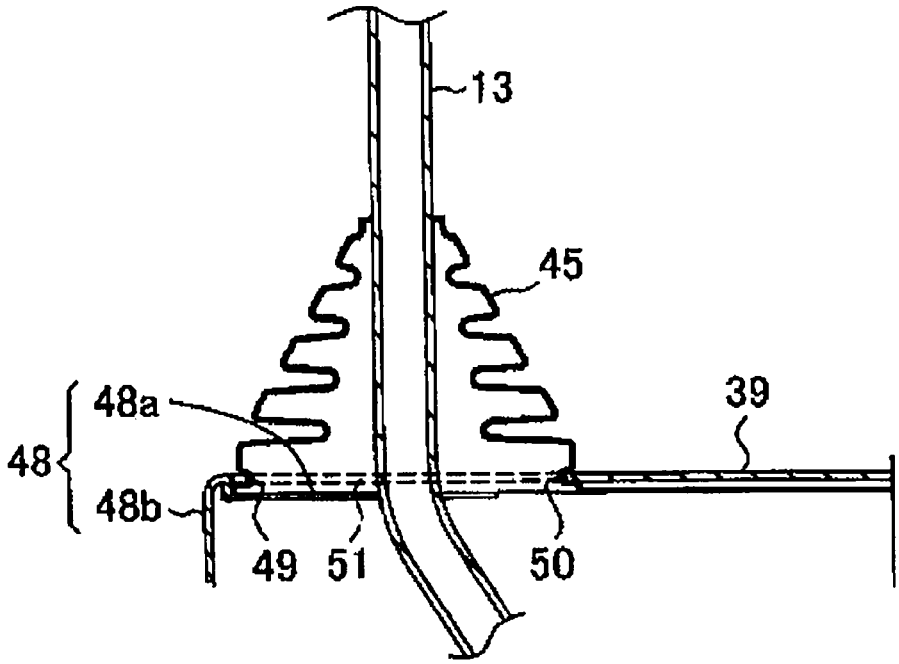
FIG. 6 is a partially enlarged sectional view of a state in FIG. 5.
Figure 7:
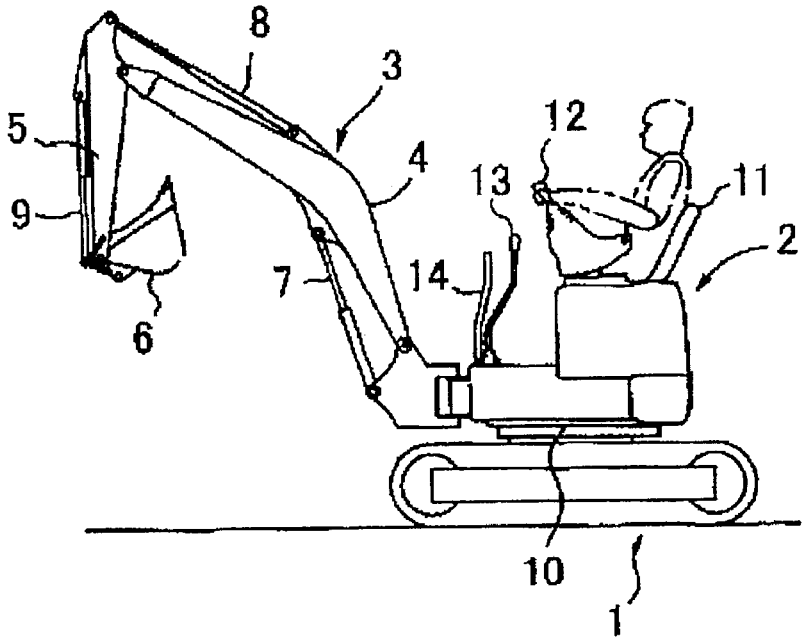
FIG. 7 PRIOR ART
FIG. 7 is a schematic side view of a small excavator serving as a preferred example of the present invention.
Figure 8:
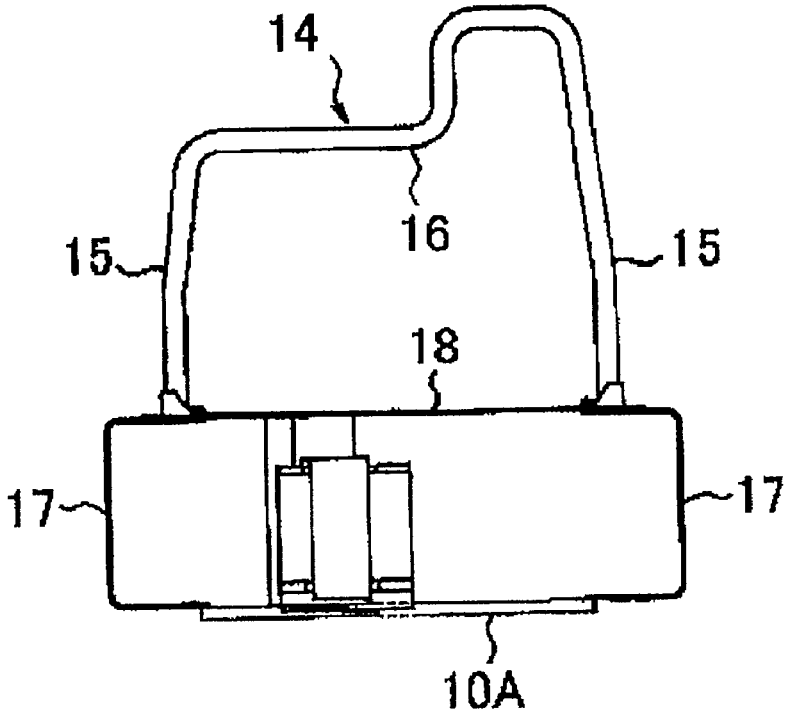
FIG. 8 PRIOR ART
FIG. 8 is a front view showing a handrail attachment structure of the small excavator with using a conventional metal-sheet upper frame.

Refer to FIGS. 4 to 6

A description will be only given to different points from the first embodiment.

In a second embodiment, a pair of left and right notches 49, 49 is provided in a central part in the left and right direction of a base plate 48, and a pair of left and right notches 50, 50 is provided in a central part in the left and right direction of the floor plate 39. The former opens backward and the latter opens forward so as to face each other.

Lever through holes 51, 51 (refer to FIGS. 5 and 6) elongated in the front and back direction are formed by the above notches 49, 49 and 50, 50 in a state that the floor plate 39 is attached. Lower parts of a pair of the operation levers (only one lever is shown in FIG. 6) 13, 13 shown in FIG. 1 pass through the above lever through holes 51, 51 and are introduced to under the floor. Lower end parts of the boots 45 for covering an extra clearance of the lever through holes 51, 51 are engaged with and fixed to peripheral parts of the lever through holes 51, 51.

In the above case, the lower end parts of the boots may be pushed into the lever through holes 51, 51 from above and engaged with the peripheral parts of the holes after attaching the floor plate 39 to the base plate 48. Alternatively, front half parts of the lower end parts of the boots may firstly be engaged with edge parts of the notches 49, 49 of the base plate 48, and then the floor plate 39 may be attached to the base plate 48 in a state that edge parts of the notches 50, 50 thereof are engaged with back half parts of the lower end parts of the boots.

It should be noted that the figures show the case where a separate plate material 48*b* (the reference numeral is only given in FIGS. 4 and 6) provided with the notches 49, 49 is attached to a central part in the left and right direction of a base plate main body 48*a* so as to form the base plate 48, as an example. However, the notches 49, 49 may directly be provided in a single-body base plate.

The same elements as the front cover attachment portions 46, 46 and the pedal attachment holes 47, 47 in the first embodiment are also provided in the second embodiment but not shown in the figures.

According to the above configuration, the base plate 48 and the floor plate 39 also serve as a boot attachment member. Therefore, there is no need for a member exclusively used for attaching the boots, and hence it is possible to decrease the number of the parts and the man-hour for assembling, and reduce the cost and improve the assembling property.

Maintenance around a link installed at bases of the operation levers 13, 13 (under the floor) or the like is performed in a state that the floor plate 39 and the boots 45, 45 are removed.

In the above case, when the lever through hole 44 is formed by curving the central part of the base plate into an U shape backward as in the first embodiment (refer to FIG. 3), the curved part covers a part of space under the floor from above so as to hinder the maintenance around the link or the like.

Meanwhile, according to the second embodiment, the lever through holes 51, 51 are formed not by the curved part but by the notches 49, 49 and hence the space under the floor can be largely opened. Therefore, it is advantageous in terms of the maintenance around the link or the like.

Other Embodiments (1) The above embodiments show the case where the cast upper frame 30 is used, as an example. However, the present invention can be applied to a case where a metal-sheet upper frame is used as well as above.

(2) Desirably, as in the above embodiment, the base plate 38 is attached between the side supports 33, 33 of the handrail, and the front end part of the floor plate 39 is attached to the above base plate 38 so as to indirectly connect the side supports 33, 33 and the floor plate 39. However, the front end part of the floor plate 39 may be directly fixed to the side supports 33, 33.

Although the invention has been described with reference to the preferred embodiments in the attached figures, it is noted that equivalents may be employed and substitutions made herein without departing from the scope of the invention as recited in the claims.

We claim:

1. A construction machine, comprising:

a lower traveling body;

an upper rotating body disposed on said lower traveling body; and a handrail formed by left and right side supports and a lateral railing both attached to a front part of an upper frame forming said upper rotating body, wherein lower ends of said side supports of the handrail are attached to an upper surface of a bottom portion of said upper frame, and a front end part of a floor plate forming a floor surface is attached astride said side supports at a higher position than a position where said side supports are attached to said upper frame.

2. The construction machine according to claim 1, further comprising:

handrail mounts provided in the bottom portion of said cast upper frame, wherein attachment holes passing through in the up and down direction are provided in said handrail mounts, attachment plates provided with screw holes are fixed to the lower ends of said side supports of said handrail, and attachment screws are screwed into said screw holes of said attachment plates in a state of passing through said attachment holes from below so that said side supports of said handrail are attached to the bottom portion of said upper frame.

3. The construction machine according to claim 1, further comprising:

a base plate for attaching said floor plate, said base plate hanged and fixed between said side supports of said handrail, wherein the front end part of said floor plate is attached to said base plate.

4. The construction machine according to claim 3, wherein notches are provided at corresponding positions of said base plate and the front end part of said floor plate so as to face each other, a lever through hole is formed by said notches, and a lower end part of a boot for covering an extra clearance in a state that an operation lever passes through said lever through hole, is engaged with and fixed to a peripheral part of said lever through hole.

* * * * *